United States Patent [19]

Haines

[11] 4,336,941

[45] Jun. 29, 1982

[54] METHOD FOR PLAYING A SQUARE FORMING GAME

[76] Inventor: Karl A. Haines, 101 Egypt Rd., Warren, Pa. 16365

[21] Appl. No.: 15,658

[22] Filed: Feb. 27, 1979

[51] Int. Cl.[3] ..... A63F 3/00

[52] U.S. Cl. ..... 273/240; 273/267

[58] Field of Search ..... 273/267, 240, 236, 243, 273/275, 276; 283/49

[56] References Cited

U.S. PATENT DOCUMENTS

| | | | |
|---|---|---|---|
| 1,065,775 | 6/1913 | Brewer | 273/248 |
| 2,169,536 | 8/1937 | Morris | 283/49 |
| 2,460,208 | 1/1949 | Zalkind | 273/240 |
| 3,638,948 | 2/1972 | Smith | 273/275 |
| 3,863,926 | 2/1975 | White et al. | 273/267 |
| 4,070,026 | 1/1978 | Cambardella | 273/243 X |
| 4,116,449 | 9/1978 | Breslow | 273/240 |

FOREIGN PATENT DOCUMENTS

| | | | |
|---|---|---|---|
| 1042543 | 11/1953 | France | 273/249 |

OTHER PUBLICATIONS

"Zig Zag" *Games and Puzzles,* Apr. 1978, p. 14.

*Primary Examiner*—Richard C. Pinkham
*Assistant Examiner*—Scott L. Brown
*Attorney, Agent, or Firm*—Larson and Taylor

[57] ABSTRACT

A method is provided for playing a square forming game wherein a plurality of dots are arranged in an array of rows and columns and the connecting lines to be drawn between adjacent dots by each of a plurality of players are determined both in direction and number by a pair of dice. One die contains numbers indicating the length of the line to be drawn for a particular roll of the dice while the other die indicates the direction in which the line (or lines) is to be drawn (left, right, up, down, etc.). The player completing the most squares wins the game.

5 Claims, 3 Drawing Figures

METHOD FOR PLAYING A SQUARE FORMING GAME

FIELD OF THE INVENTION

This invention generally relates to a method for playing of a square forming game and, more particularly, to a method wherein a pair of dice are used in playing the game to control the formation of connecting lines between the dots.

BACKGROUND OF THE INVENTION

A popular game which has been enjoyed by many people throughout the years involves the formation of square by joining pairs of dots which lie at the four corners of the square. In the simplest form of the game, each player joins two dots with a connecting line during his or her turn and any player completing a square with a connecting line marks the square with his or her mark and is given another turn. The player completing the most squares is declared the winner. Other forms of the basic square forming game are disclosed in the prior art. For example, in U.S. Pat. No. 3,863,926 (White et al), a relatively simple form of the game is disclosed wherein each player takes a turn in forming one connecting line on the board between pegs or dots. In one embodiment of the invention, a spinner is used during each turn to determine whether each player must place his line in a horizontal or vertical manner.

Other types of area enclosing games are disclosed in the prior art, such as U.S. Pat. Nos. 262,066 (Linton); 2,901,255 (Sutherland); and 3,948,524 (Ladd et al).

SUMMARY OF THE INVENTION

The present invention concerns a novel method of playing a square forming game and provides a high degree of chance in the playing of the game as well as a wide variety of moves as compared with the prior art.

In accordance with the invention, a method of playing a square forming game is provided which utilizes a playing surface having a plurality of dots which are arranged in a rectangular array of rows and columns to form a square forming area and which are adapted to be connected together by lines to form a plurality of squares, and employs a pair of six-sided dice. The sides of one die are individually marked with different numerals dictating the overall lenghts of the connecting lines to be drawn while the sides of the other die are marked with indications corresponding to the direction in which connecting lines between the dots may be made. The six markings on said other die provide for movement in the directions left to right, right to left, up and down, as well as for movement in any direction, and in any direction using two or more divided lines.

The game is played by rolling the pair of dice to determine the number and direction of connecting lines to be made between adjacent dots, and thereafter connecting adjacent dots by connecting lines in accordance with the markings of the dice as rolled, i.e., the uppermost markings, the rolling of the dice and the corresponding connecting of adjacent dots being carried out by the players of the game in turn. As in conventional square forming games, the players mark any squares which are completed by connecting lines, between the dots, which define the sides of such a square with an identification mark identifying the player who completed the square.

A winner is determined when all dots have been connected to form all squares, the winner being the player who has completed the largest number of squares.

In a preferred embodiment of the invention, the connecting lines are initially started on the periphery of the array in question, and each successive line drawn in that same direction must start at the end of any noncompleted line already drawn in that direction.

Advantageously, the playing surface also contains a score-keeping area and the playing surface is provided on a printed page, a plurality of these printed pages being gathered together along one edge, and each printed page, after use, being torn from the gathered printed pages such that a new, unused printed page is ready to be used. The score-keeping area preferably includes a series of columns, which are located adjacent to one edge of said square forming area and divided into rows by lines which are extensions of the lines formed by the dots of said square forming area. This permits counting, when the game is completed, of the number of squares in each row of the square forming area having each player's identification mark therein, writing the number of squares formed by each player in the row of the score-keeping area, in a column corresponding to that player, and adding of the numbers together in each player's column to determine the player with the highest total.

Other features and advantages of the present invention are set forth in or apparent from the detailed description of a preferred embodiment of the invention found hereinbelow.

DETAILED DESCRIPTION OF THE PREFERRED EMBODIMENT

Figure 1:
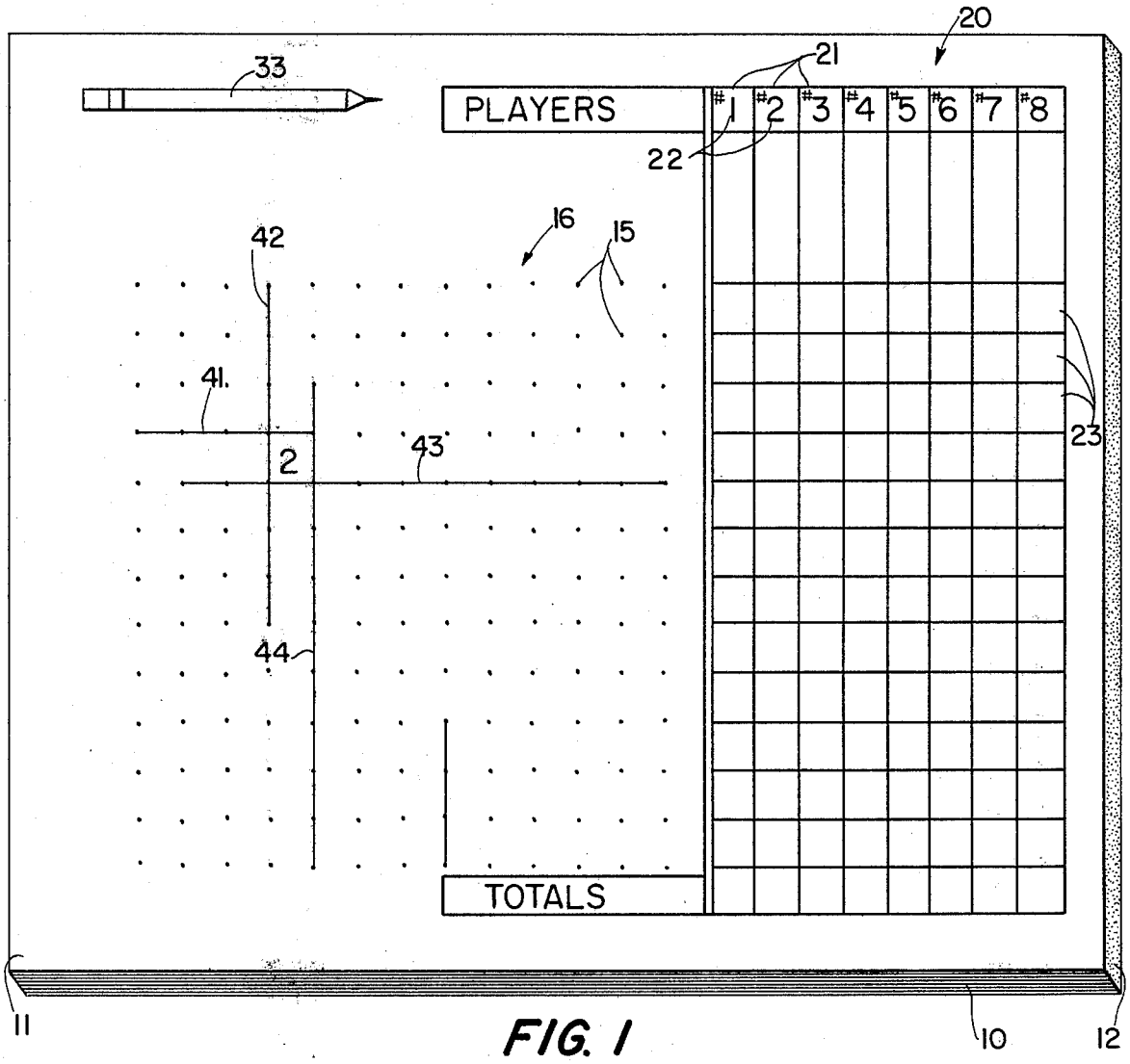
FIG. 1 is a perspective view of a stack of printed pages illustrating the game playing surface and score-keeping area of the game of the invention.
Figure 2:
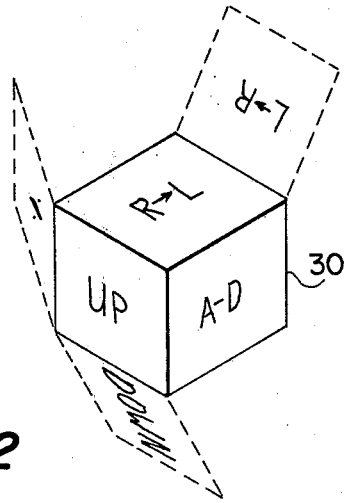
FIG. 2 is a perspective view of one of the dice employed in the game of the invention.

Referring to the drawings, a presently preferred embodiment of the present invention is depicted in FIGS. 1 and 2. FIG. 1 shows a playing surface 11 which is printed on a plurality of pages 10 which are gathered together along one edge 12 by glue or other suitable fastening means to form a booklet or the like. After one game is completed, that page is ripped off of edge 12 and a new page is exposed which contains a new playing surface.

Playing surface 11 contains two different areas. A square forming area 16 is formed by a plurality of dots 15 arranged in a rectangular array of rows and columns. The other area is the score-keeping area 20. Score-keeping area 20 is divided into a series of columns 21 with a player identification mark 22 at the top of each column 21. In this case, player identification marks 22 are numbers, but they could easily be other identification means such as names or initials. Columns 21 are placed adjacent one edge of square forming area 16 and divided into rows 23 which are extensions of the rows formed by dots 15.

Figure 3:
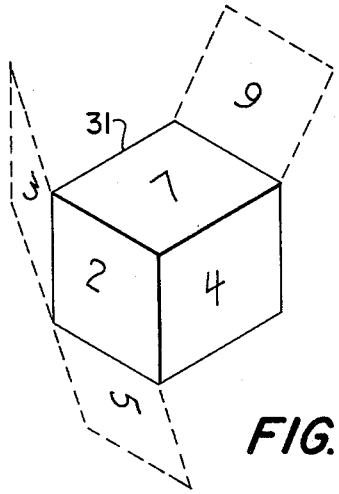
FIG. 3 is a perspective view of the other one of the dice employed in the game of the invention.

As discussed above, a pair of dice is used for playing of the game. FIG. 2 is a perspective view of a number die 30 and FIG. 3 is a perspective of a direction die 31.

Number die 30 is six-sided and is marked with numbers 2, 3, 4, 5, 6 and 7 which correspond to the number of corresponding lines to be drawn during one turn. Direction die 31 also has six sides. These are marked with symbols representing the directions the connecting lines are to be drawn, viz. L-R (left to right), R-L (right to left), UP, DOWN, A-D (any direction), and ÷ (any direction with two or more divided lines as explained below).

The game is played in the following manner. To begin play, each player rolls number die 30 and the player rolling the highest number goes first. After that, play proceeds to the left. Each player takes one turn in rolling the dice 30 and 31, and in drawing continuous connecting lines as indicated by the dice. For this latter purpose a pencil 33 or like instrument is used.

As an example, if the combination 4, L-R is thrown, a line 41 shown in FIG. 1 may be drawn. Likewise, if 7, DOWN is thrown, a line 42 may be drawn.

In accordance with the rules of the game, lines must be started at a dot 15 on the periphery of the playing area. After a line is started each successive line drawn in that same direction must start at the end of any non-completed line heading in that same direction. A non-completed line refers to a continuous line which does not extend from one edge or periphery to the other. For example, line 43 is a non-completed line which could be the result of a throw of 4, R-L and later of a throw of 7, R-L. If a player completes a line in less than the number of connecting lines indicated on number die 30, he must continue to draw another continuous line in the same direction wherever appropriate, up to the number of connecting lines indicated by number die 30.

When the direction die 31 reads A-D, the player may draw the number of connecting lines shown on number die 30 in any direction the player chooses. On the other hand, when direction die reads ÷, the player must draw two or more separate, unconnected lines with the total number of connecting lines equaling the number thrown on number die 30. Near the end of the game, if a player cannot draw the total number of connecting lines indicated, he loses his turn after drawing as many lines as he can.

The object of the game is to form completed squares by connecting lines between four dots 15 which form the corners of that square. When a square is completed, the player completing it puts his player identification mark in its center. For example, the square formed by lines 41, 42, 43 and 44 has a player identification number "2" inside of it. If a player forgets to place his mark inside of a completed square, the square will belong to that player who places his mark inside the square when it is that player's turn to roll the dice.

The game is ended when all of the squares available have been formed. At this time, the winner is decided by determining which player has the most squares with his player identification mark inside. To make this determination easier, score-keeping area 20 is used. For each row of squares, the number of squares containing each player's identification mark is written in the same row of the score-keeping sheet, underneath of the appropriate column containing the player identification mark. Thus, if player "2" eventually completed four squares in the fourth row, this would be indicated in that row on the score sheet under the numeral "2". After this procedure has been followed for all of the rows, it is then a simple matter to add all of the numbers in each player's column and thereby determine the winner.

Other alternative embodiments of the invention should be apparent to those of ordinary skill in the art. For instance, rather than having to draw a continuous line, the player could be given the option of drawing the number of connecting lines shown on number die 30 at any place desired.

Although the invention has been described in detail with respect to exemplary embodiments thereof, it will be understood by those of ordinary skill in the art that variations and modifications may be effected within the scope and spirit of the invention.

I claim:

1. A method of playing a square forming game utilizing a playing surface having a plurality of dots which are arranged in a rectangular array of rows and columns to form a square forming area and which are adapted to be connected together by lines to form a plurality of squares, and employing a pair of six-sided dice, the sides of one die being individually marked with different numerals indicating the overall lengths of the lines to be drawn, respectively, and the sides of the other die being marked with indications of the direction in which connecting lines between the dots may be drawn, the six markings on said other die providing for drawing of such a line in the directions left to right, right to left, up and down, respectively, and in any direction, and in any direction in two or more separate divided lines, respectively, said method comprising:

rolling said pair of dice to determine the number and direction of connecting lines to be made between adjacent dots, connecting adjacent dots by connecting lines in accordance with the uppermost markings of the dice as rolled, said connecting step comprising drawing a line from left to right when the said other die indicates left to right, drawing a line from right to left when said other die indicates right to left, drawing a line up when said other die indicates up, drawing a line down when said other die indicates down, drawing a line in any direction when said other die indicates any direction and drawing at least two lines in any direction when said other die indicates in any direction in two or more separate divided lines, the rolling of the dice and the corresponding connecting of adjacent dots being carried out by the players of the game in turn, said connecting lines being initially started on the periphery of said array, and each successive line drawn in that same direction starting at the end of any non-completed line already drawn in that direction, marking any squares which are completed by connecting lines, between the dots, which define the sides of said squares, with an identification mark identifying the player who completed the square, and determining, when all dots have been connected to form all squares, the player who has completed the largest number of squares.

2. A method of playing a square forming game as claimed in claim 1, wherein said playing surface also contains a score-keeping area.

3. A method of playing a square forming game as claimed in claim 2, wherein said playing surface is provided on a printed page, and a plurality of said printed pages are gathered together along one edge, each printed page, after use, being torn from said plurality of gathered printed pages such that a new, unused printed page is ready to be used.

4. A method of playing a square forming game as claimed in claim 3, wherein a writing instrument is used forming the connecting lines.

5. A method of playing a square forming game utilizing a playing surface having a plurality of dots which are arranged in a rectangular array of rows and columns to form a square forming area and which are adapted to be connected together by lines to form a plurality of squares, said playing surface also containing a score-keeping area, and employing a pair of six-sided dice, the sides of one being individually marked with different numerals indicating the overall lengths of the lines to be drawn, respectively, and the sides of the other die being marked with indications of the direction in which connecting lines between the dots may be drawn, the six markings on said other die providing for drawing of such a line in the directions left to right, right to left, up and down, respectively, and in any direction, and in any direction in two or more separate divided lines, respectively, said method comprising:

rolling said pair of dice to determine the number and direction of connecting lines to be made between adjacent dots, connecting adjacent dots by connecting lines in accordance with the uppermost markings of the dice as rolled, said connecting step comprising drawing a line from left to right when the said other die indicates left to right, drawing a line from right to left when said other die indicates right to left, drawing a line up when said other die indicates up, drawing a line down when said other die indicates down, drawing a line in any direction when said other die indicates any direction and drawing at least two lines in any direction when said other die indicates in any direction in two or more separate divided lines, the rolling of the dice and the corresponding connecting of adjacent dots being carried out by the players of the game in turn, marking any squares which are completed by connecting lines, between the dots, which define the sides of said squares, with an identification mark identifying the player who completed the square, and determining, when all dots have been connected to form all squares, the player who has completed the largest number of squares, said score-keeping area including a series of columns, the columns being placed adjacent one edge of said square forming area and divided into rows by lines which are extensions of the lines formed by the dots of said square forming area, said method comprising the further steps of:

counting, when the game is completed, the number of squares in each row of said square forming area with each player's identification mark therein, writing the number of squares formed by each play in the row of said score-keeping area which lies adjacent to said row of the square forming area in a column corresponding to that player, and adding the numbers together in each player's column to determine the player with the highest total.

* * * * *